US010947949B2

(12) United States Patent
Lee et al.

(10) Patent No.: US 10,947,949 B2
(45) Date of Patent: Mar. 16, 2021

(54) SELF-DIAGNOSIS METHOD FOR IGNITION COIL, ELECTRONIC CONTROL UNIT FOR PERFORMING THE SELF-DIAGNOSIS, AND SELF-DIAGNOSTIC SIGNAL GENERATOR FOR THE SELF-DIAGNOSIS

(71) Applicants: Hyundai Motor Company, Seoul (KR); Kia Motors Corporation, Seoul (KR)

(72) Inventors: Dong-Soo Lee, Gyeonggi-do (KR); Jung-Hun Lee, Gyeonggi-do (KR); Sung-Kwan Bae, Chungcheongnam-do (KR); Do-Geun Jung, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/687,199

(22) Filed: Nov. 18, 2019

(65) Prior Publication Data

US 2020/0300209 A1 Sep. 24, 2020

(30) Foreign Application Priority Data

Mar. 21, 2019 (KR) ..... 10-2019-0032478

(51) Int. Cl.
*F02P 17/12* (2006.01)
*F02P 11/06* (2006.01)

(52) U.S. Cl.
CPC ..... *F02P 17/12* (2013.01); *F02P 11/06* (2013.01)

(58) Field of Classification Search
CPC ..... F02P 17/12; F02P 11/06
See application file for complete search history.

(56) References Cited

U.S. PATENT DOCUMENTS 6,886,547 B2 * 5/2005 Butler, Jr. ..... G01L 23/225 123/606

FOREIGN PATENT DOCUMENTS

KR 100579283 B1 5/2006

* cited by examiner

*Primary Examiner* — Hieu T Vo
(74) *Attorney, Agent, or Firm* — Mintz Levin Cohn Ferris Glovsky and Popeo, P.C.; Peter F. Corless

(57) ABSTRACT

A self-diagnosis method for an ignition coil includes receiving and confirming a current flag (C/F) signal through monitoring of primary current of an ignition coil; monitoring secondary current of the ignition coil upon receiving the C/F signal and confirming whether a fault flag (F/F) signal for determining whether misfire of the ignition coil occurs is input; and determining whether an abnormal signal of the ignition coil is generated based on the result of confirming the C/F signal and the F/F signal respectively.

20 Claims, 5 Drawing Sheets

SELF-DIAGNOSIS METHOD FOR IGNITION COIL, ELECTRONIC CONTROL UNIT FOR PERFORMING THE SELF-DIAGNOSIS, AND SELF-DIAGNOSTIC SIGNAL GENERATOR FOR THE SELF-DIAGNOSIS

CROSS-REFERENCE TO RELATED APPLICATION(S)

This application claims under 35 U.S.C. § 119(a) the benefit of Korean Patent Application No. 10-2019-0032478, filed on Mar. 21, 2019, the entire contents of which are incorporated herein by reference.

BACKGROUND

(a) Technical Field

The present disclosure relates to a self-diagnosis method for an ignition coil, an electronic control unit for performing the self-diagnosis, and a self-diagnostic signal generator for the self-diagnosis, more particularly, to the self-diagnosis method, the electronic control unit. and the self-diagnostic signal generator that are configured to confirm in real time whether a process of generating a transformation of a voltage from a primary coil to a secondary coil is performed smoothly through monitoring both a primary current and a secondary current, which can be implemented by incorporating a self-diagnosis circuit for detecting whether or not an abnormal state occurs in the ignition coil.

(b) Description of the Related Art

An ignition coil is a small transformer that transforms voltage of a battery to 30 kV or more to create a spark in a spark plug gap of a cylinder.

An operation principle of the ignition coil is now described in detail. When an igniter is energized according to an ignition signal of an electronic control unit (hereinafter, referred to as "ECU"), electric current flows gradually to a primary coil. At this time, the primary coil forms a magnetic force while electric current flows therein.

Thereafter, the igniter is short circuited according to the ignition signal from the ECU, and then electric current to the primary coil is cut off. At this time, a rapid change in magnetic flux is induced and generated in a secondary coil due to mutual induction action whereby the secondary coil generates secondary voltage (high voltage) depending on a winding ratio.

Then, the secondary voltage is applied in the spark plug gap, and in turn, electric discharge occurs while an electric field is destroyed, with the result that a spark is created.

However, it is difficult to diagnose disconnection/short circuiting of the ignition coil because of characteristics of a switching circuit therefor. This is caused by characteristics of the switching circuit in which the igniter is essentially disconnected, and if required, generates induced electromotive force by instantaneous switching in a time frame of about 1/1,000 second. Moreover, the ignition coil does not have a separate diagnostic trouble code (DTC).

Further, it is difficult for the ECU to obtain the relevant information when the function for protecting the ignition is activated or when a failure occurs due to continuous electric conduction. In this case, non-control of the ECU inevitably occurs.

In addition, there is a limitation that it is difficult to specifically designate a disabled component only based on disconnection/short circuiting of the switching circuit which is connected physically before an actual vehicle is checked.

Therefore, the ignition coil must have not only a function of detecting an abnormality by diagnosing an internal fault of the ignition coil, but also a self-protection function because it is essentially exposed to the danger of overvoltage, overcurrent, or generation of heat.

SUMMARY

An object of the present disclosure is to provide a self-diagnosis method for an ignition coil and an electronic control unit for performing the self-diagnosis and a self-diagnostic signal generator for the self-diagnosis that are configured to confirm in real time whether a process of generating a transformation of voltage from a primary coil to a secondary coil is performed smoothly through monitoring of both a primary current and a secondary current, which can be implemented by incorporating a self-diagnosis circuit for detecting whether or not an abnormal state occurs in the ignition coil.

Other objects and advantages of the present disclosure can be understood by the following description and become apparent with reference to the embodiments of the present disclosure. Also, it is apparent to those skilled in the art to which the present disclosure pertains that the objects and advantages of the present disclosure can be realized by the methods and/or apparatuses as claimed and combinations thereof.

In accordance with one aspect of the present disclosure, there may be provided a self-diagnosis method for an ignition coil, comprising: receiving and confirming a current flag (C/F) signal through monitoring of primary current of an ignition coil by an electronic control unit (ECU); monitoring, by the ECU, secondary current of the ignition coil upon receiving the C/F signal and confirming whether a fault flag (F/F) signal for determining whether misfire of the ignition coil occurs is input; and determining, by the ECU, whether an abnormal signal of the ignition coil is generated based on the result of confirming the C/F signal and the F/F signal respectively.

The C/F signal may be a square wave shaped self-diagnostic signal obtained by inverting voltage of a diagnostic line when the primary current passes along two preset specific current value points.

The F/F signal may be a self-diagnostic signal to be transmitted when energy of the secondary current of the ignition coil does not exceed a threshold value or when secondary voltage of the ignition coil is not generated.

The energy of the secondary current may be determined based on magnitude and duration of the current of the ignition coil.

The receiving and confirming the C/F signal may comprise confirming whether an inverted edge of the C/F signal falls within a tolerance time of each of the two specific current value points set in mapping data.

The mapping data may be established by measuring time of each of the two specific current value points when the primary current rises depending on conditions of battery voltage, temperature and revolution per minute (RPM) in a single product of the actual ignition coil.

The time of each of the two specific current value points set in the mapping data may have a range between a high value and a low value depending on the battery voltage.

The time of each of the two specific current value points set in the mapping data may be set after confirming an overlap section.

The determining whether an abnormal signal of the ignition coil is generated may comprise storing a diagnostic trouble code (DTC) in a memory device when the number of times of generating an abnormal signal exceeds a preset threshold value.

In accordance with another aspect of the present disclosure, there may be provided an electronic control unit (ECU) comprising at least one processor and a memory device for storing computer readable commands wherein the commands, when executed by the at least one processor, cause the electronic control unit to receive and confirm a current flag (C/F) signal through monitoring of primary current of an ignition coil; to proceed to monitoring of secondary current of the ignition coil upon receiving the C/F signal and confirm whether a fault flag (F/F) signal for determining whether misfire of the ignition coil occurs is input; and to determine whether an abnormal signal of the ignition coil is generated based on the result of confirming the C/F signal and the F/F signal respectively.

In accordance with yet another aspect of the present disclosure, there is provided a self-diagnostic signal generator comprising at least one processor and a memory device for storing computer readable commands wherein the commands, when executed by the at least one processor, cause the self-diagnostic signal generator to be connected to a ground (GND) of a primary side of an ignition coil and monitor primary current; to be connected to a power source of a secondary side of the ignition coil and monitor secondary current; and to transmit a current flag (C/F) signal to an electronic control unit based on the result of monitoring the primary current of the ignition coil and transmit a fault flag (F/F) signal to the electronic control unit based on the result of monitoring the secondary current of the ignition coil.

According to embodiments of the present disclosure implemented by incorporating a self-diagnosis circuit for detecting whether or not an abnormal state occurs in the ignition coil, it is possible to confirm in real time whether the process of generating transformation of the voltage from a primary coil to a secondary coil is performed smoothly through monitoring of both the primary current and the secondary current.

Further, the present disclosure can contribute to improvement of analysis and quality of actual problematic components by reducing the no trouble found (NFT) problem through diagnosing of an internal fault of the ignition coil.

Further, the present disclosure makes it possible to distinguish whether the cause of the problem at the time of occurrence of misfire is on the ignition coil side or otherwise another problem inside the cylinder so that it is possible to easily map out a repair direction, thereby saving cost and time for repair.

Further, the present disclosure can be utilized directly in a future misfire diagnostic logic in place of a way of indirectly confirming change in rotating speed of a crankshaft angle sensor or the like in the case of diagnosing misfire.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The above and other objects, features and other advantages of the present disclosure will be more clearly understood from the following detailed description taken in conjunction with the accompanying drawings, in which.

DESCRIPTION OF SPECIFIC EMBODIMENTS

Figure 1:
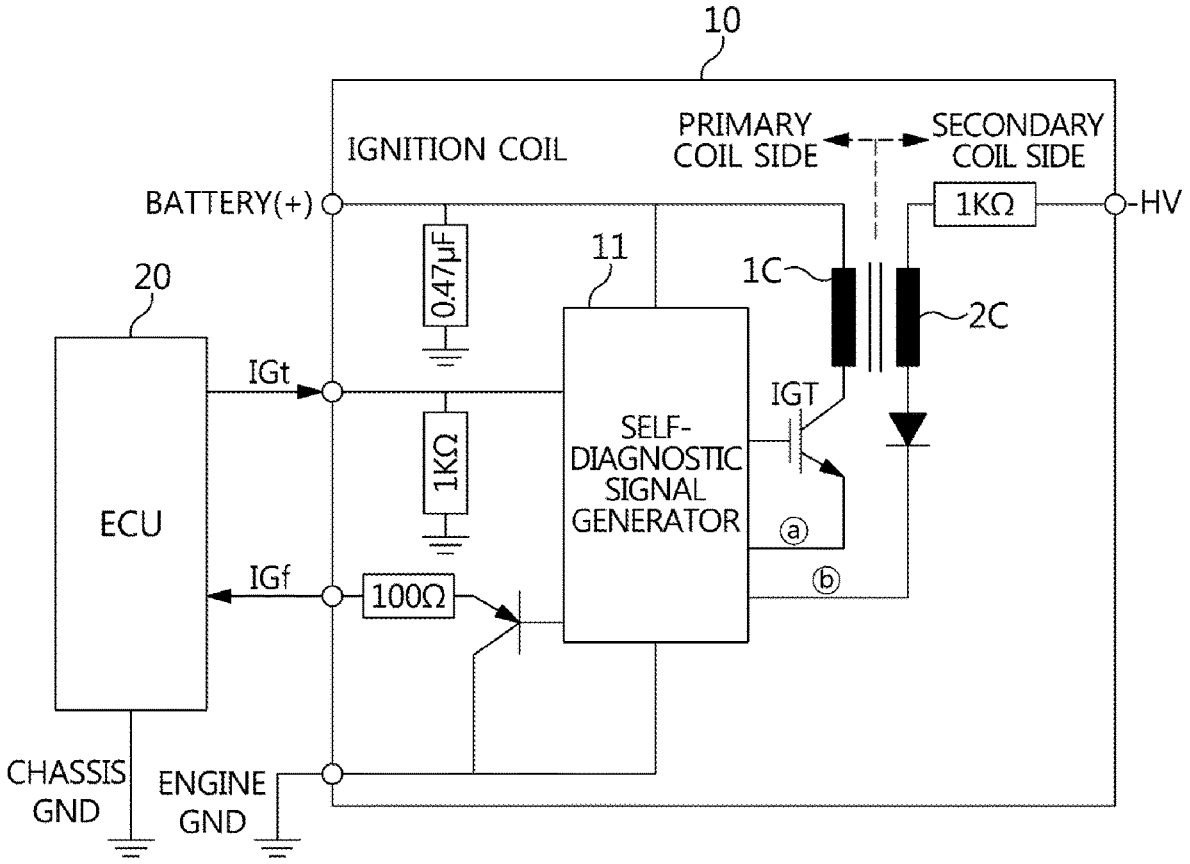
FIG. 1 is a schematic diagram showing an ignition coil and an electronic control unit according to an embodiment of the present disclosure.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

The term "part" refers to a software element or a hardware element such as a field-programmable gate array (FPGA) or application-specific integrated circuit (ASIC) and performs a certain role. However, the term "part" is not limited to software or hardware. The term "part" may be configured to be in a storage medium that may be addressed or may be configured to reproduce one or more processors. Therefore, as an example, the term "part" includes elements such as software elements, object-oriented software elements, class elements and task elements, processes, functions, attributes, procedures, subroutines, segments of a program code, drivers, firmware, micro-codes, circuits, data, database, data structures, tables, arrays and parameters. Functions provided in elements and "parts" may be combined with the smaller number of elements and "parts" or may be divided into additional elements and "parts."

Hereinafter, embodiments of the present disclosure will be described in detail with reference to the accompanying drawings such that those skilled in the art can easily carry out the present disclosure. However, the present disclosure may be implemented in many different forms but not limited thereto. In order to clearly describe the present disclosure, parts not related to the description are omitted and similar parts are denoted by like reference characters throughout the specification.

Preferred embodiments of the present disclosure will be described below in more detail with reference to the accompanying drawings.

Figure 2:
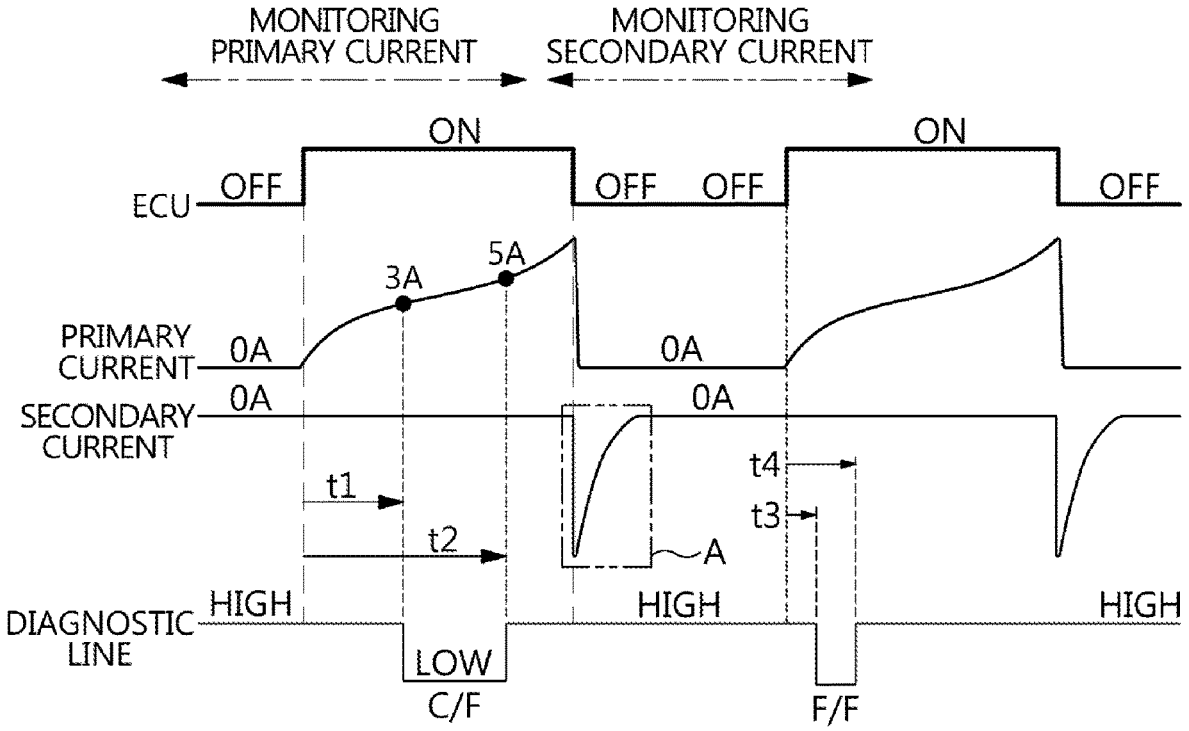
FIG. 2 is a plot for illustrating a self-diagnostic signal.

FIG. 1 is a schematic diagram showing an ignition coil and an electronic control unit according to an embodiment of the present disclosure, and FIG. 2 is a plot for illustrating a self-diagnostic signal.

As shown in FIG. 1, an ignition coil 10 and an electronic control unit (hereinafter, referred to as "ECU") 20 according to an embodiment of the present disclosure are designed to incorporate a self-diagnosis circuit for detecting whether an abnormal state occurs inside the ignition coil 10 in cooperation with the ignition coil 10 and the electronic control unit 20 so that it is possible to confirm in real time whether or not the process of generating transformation of the voltage from a primary coil to a secondary coil is performed smoothly.

The ignition coil 10 may comprise an igniter IGT, a primary coil 1C, a secondary coil 2C, a center core (not shown), an outer core (not shown) and a permanent magnet (not shown).

The igniter IGT is a type of switch that allows electric conduction to a circuit of the primary coil side to occur or cuts off the electric conduction in response to an ignition signal from the ECU 20 during a dwell time (hereinafter, referred to as "D/T"). Here, the "D/T" corresponds to a time of electric conduction to the primary coil 1C.

Specifically, when the electric conduction to the igniter IGT occurs in response to the ignition signal from the ECU 20, electric current gradually flows to the primary coil 1C where magnetic force is generated.

On the other hand, when the electric conduction to the igniter IGT is cut off in response to the ignition signal from the ECU 20, rapid change in magnetic flux is induced and generated in the secondary coil side due to mutual induction action of the primary coil side, and in turn, high voltage (secondary voltage) is generated depending on a winding ratio between the coils. As this time, the secondary voltage is applied in the spark plug gap and, in turn, electric discharge occurs while electric field is destroyed, with the result that a spark is created.

On the other hand, the center core and the outer core form a closed magnetic circuit such that magnetic flux can flow smoothly. At this time, since the center core and the outer core are structures formed by stacking thin silicon steel plates, a magnitude of ignition energy and the secondary holding voltage are determined depending on a magnitude of magnetic energy that can be contained in the iron cores.

In addition, if a direction of magnetic flux of the permanent magnet is set to be opposite to a direction of magnetic flux formed by electric conduction during the D/T, a larger change in magnetic flux can be expected at the time when electric current to the primary coil side is cut off.

In particular, the ignition coil 10 may comprise a self-diagnostic signal generator 11 for generating a self-diagnostic signal indicating whether an abnormal signal is generated in each of the primary and secondary coil sides.

Here, the self-diagnostic signal generator 11 may comprise at least one processor and a memory device for storing computer readable commands. In this case, when the computer readable commands are executed by the at least one processor, the self-diagnostic signal generator 11 performs a self-diagnostic signal generation process according to an embodiment of the present disclosure.

At this time, the ECU 20 performs a self-diagnosis process for determining whether an abnormal state occurs in the ignition coil 10 based on the self-diagnostic signal generated by the self-diagnostic signal generator 11.

Here, the ECU 20 may comprise at least one processor and a memory device for storing computer readable commands. Accordingly, when the computer readable commands are executed by the at least one processor, the ECU 20 performs a self-diagnosis method for an ignition coil.

The self-diagnostic signal generator 11 first constitutes an internal circuit for generating a self-diagnostic signal after monitoring current and voltage at each of the primary and secondary coil sides of the ignition coil 10 wherein the generator monitors the primary current by connecting a GND ⓐ of the primary coil side to the internal circuit and the secondary current by connecting a GND ⓑ of the secondary coil side to the internal circuit.

The internal circuit to be constituted by the self-diagnostic signal generator 11 may be implemented by means of semiconductor chips and related components, or a substrate (PCB).

Hereinafter, the self-diagnostic signal will be described first before describing monitoring operation for the primary current and the secondary current in the self-diagnostic signal generator 11.

The self-diagnostic signal is a standard signal indicating generation of an abnormal signal for each of the primary and secondary coil sides of the ignition coil 10 wherein a criterion of the self-diagnostic signal to be transmitted from the self-diagnostic signal generator 11 to the ECU 20 is defined in advance.

At this time, the self-diagnostic signal is transmitted as a flag type signal which notifies generation or establishment of a certain condition or a specific state. In other words, the self-diagnostic signal is transmitted by way of transmitting a flag.

Referring to FIG. 2, the self-diagnostic signal to be transmitted from the self-diagnostic signal generator 11 to the ECU 20 is defined as two types, i.e., a current flag (hereinafter, referred to as 'C/F') and a fault flag (hereinafter, referred to as 'F/F').

This C/F signal is generated in the form of a square wave when the primary current passes along two specific current value points (see reference numbers 3A and 5A in FIG. 2). In this case, the time of generating the C/F signal is the time of passing along the two specific current value points wherein it corresponds to t1 and t2 with respect to the D/T starting point, respectively.

In addition, the F/F signal is generated in the form of a square wave after the next D/T starts only when a problem is determined as having occurred through monitoring of the secondary current after the C/F signal is generated. In this case, the time of generating the F/F signal corresponds to t3 and t4 with respect to the next D/T starting point, respectively.

Here, the expression 'when a problem is determined as having occurred' encompasses a case where energy of the secondary current (magnitude and duration of current) does not exceed a threshold value in the test (see FIG. 4), and a case where the secondary voltage is not generated.

As described above, the C/F signal must be always transmitted to the ECU 20, while the F/F signal is transmitted after the next D/T starting point only when a problem occurs. Accordingly, the ECU 20 determines as a normal state when the C/F signal is always input but the F/F signal is not generated. In other words, the ECU 20 determines as a failure state when the C/F signal is not input but the F/F signal is input.

In addition, the C/F signal and the F/F signal cannot be simultaneously transmitted within the same D/T and the C/F signal is not transmitted when the F/F signal is transmitted.

Next, the self-diagnostic signal is switched by voltage of a battery (about 14 V) and transmitted in a square wave. In other words, the ECU 20 recognizes the C/F signal and the F/F signal which are self-diagnostic signals through variation of a voltage value on a diagnostic line.

Next, the times t1 and t2 of the two specific current value points 3A and 5A of the C/F signal are optimally set depending on characteristics of the ignition coil.

In addition, the F/F signal is set to be larger than 200 μs which is the minimum pulse time that can be recognized by the ECU 20 and is set to be t3=75±25 μs and t4=375±50 μs so as not to overlap with the C/F signal. In other words, the ECU 20 needs a duration of at least 200 μs.

The above-mentioned self-diagnostic signals are briefly summarized in Table 1 below.

However, the rise of the primary current exhibits a certain characteristic depending on conditions of battery voltage, temperature and revolution per minute (RPM). In other words, t1 and t2 of the C/F signal preferably exhibit certain characteristics depending on conditions of battery voltage, temperature and RPM.

As such, the ECU 20 stores in advance mapping data in which t1 and t2 of the two specific current value points are measured actually and set depending on conditions of battery voltage, temperature and RPM in a single product of the actual ignition coil.

Here, the mapping data is related to a diagnosis area of the primary current wherein it is preferable to set t1 and t2 using only the battery voltage as a variable. In other words, the temperature variable is the atmospheric temperature of the ignition coil 10, which is difficult for the ECU 20 to confirm. The ECU 20 can indirectly estimate the atmospheric temperature of the ignition coil 10 through temperature of engine coolant but the control sensitivity may be low. Further, since the RPM variable has the same value for each battery voltage, mapping values can be simple if the range of each of t1 and t2 is defined using only the battery voltage.

Figure 3:
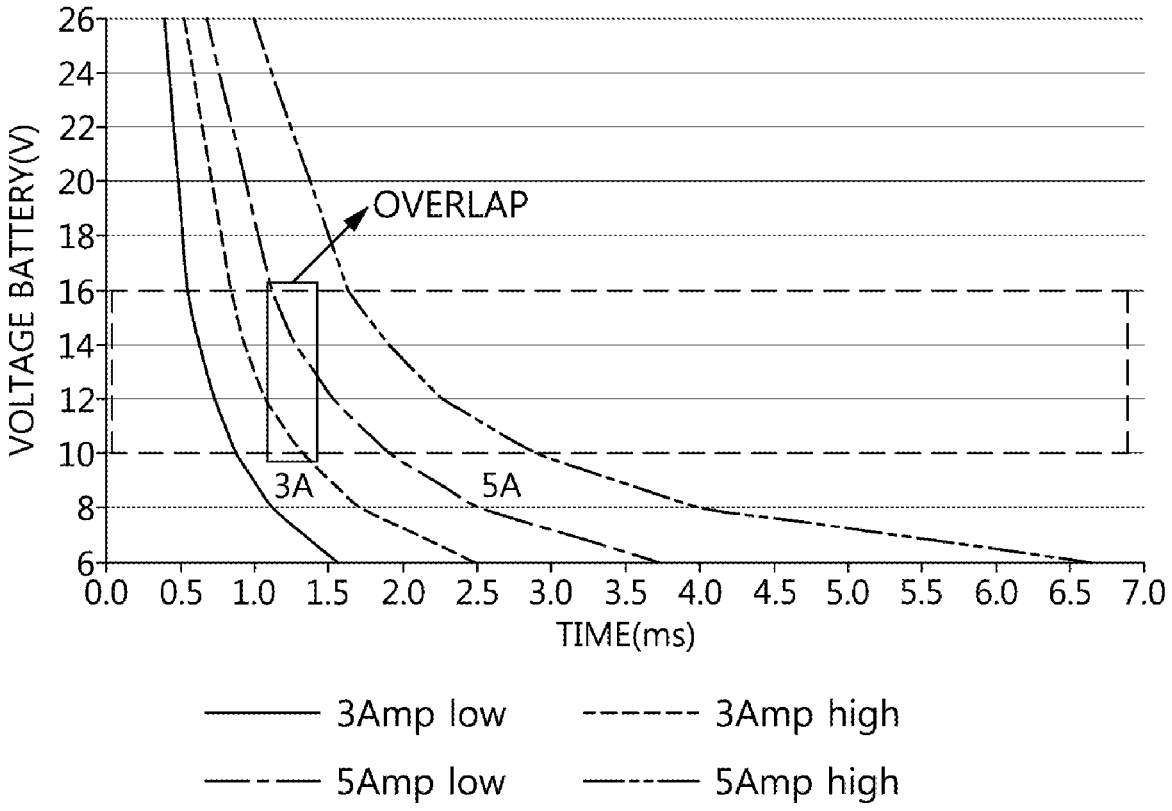
FIG. 3 is a graph showing mapping data depending on voltage of a battery.

Referring to FIG. 3, if the t1 and t2 are set in the mapping data using only the battery voltage as a variable, the t1 may have a high/low value depending on the battery voltage when the specific current value of the primary current is in 3A while the t2 may have a high/low value depending on the battery voltage when the specific current value of the primary current is in 5A. As described just above, each of the t1 and t2 has a range between a high value and a low value depending on the battery voltage. FIG. 3 is a graph showing mapping data depending on voltage of a battery.

As described above, it is desirable to check an overlap section in consideration of a tolerance when setting the mapping data. As can be seen in FIG. 3, if there is no overlap section between the high value of t1 and the low value of t2, conditions are removed and the data is simplified, whereas if the overlap section is excessive, a specific current value is changed.

TABLE 1

| Self-diagnostic signal | | Way of transmitting a flag | | Set values |
|---|---|---|---|---|
| Primary current | C/F | Transmitting two points in real time | t1 | Set depending on characteristics of an ignition coil |
| | | | t2 | Set depending on characteristics of an ignition coil |
| Secondary current | F/F | When a problem occurs, Transmitting after the next D/T starts | t3 | 75 ± 25 μs |
| | | | t4 | 375 ± 50 μs |

Hereinafter, a monitoring operation for the primary current and the secondary current in the self-diagnostic signal generator 11 will be described.

First, the self-diagnostic signal generator 11 is configured such that when performing the monitoring operation for the primary current after being connected to the GND of the primary coil 1C, it can be determined whether the ignition coil 10 can exhibit minimum performance by confirming that the primary current is rising and then cut off or that the slope of the rising curve falls within a proper range.

Specifically, the self-diagnostic signal generator 11 transmits to the ECU 20 the C/F signal in the form of a square wave, which is obtained by inverting voltage on the diagnostic line, when the primary current passes along the two specific current value points. Here, the two specific current value points may be 3A and 5A as described above.

The diagnosis area of the primary current can be set in consideration of a basic OBD diagnosis entry condition (battery voltage is 10V or more). In the case of FIG. 3, the range of the battery voltage can be limited to a range between 10 V and 16 V.

On the other hand, when receiving the C/F signal from the self-diagnostic signal generator 11, the ECU 20 confirms whether an inverted edge of the C/F signal is input within the tolerance time of t1 and t2 stored in the mapping data. Here, the inverted edge of the C/F signal can be understood as points where inversion of the diagnostic line starts and ends because the C/F signal is a square wave.

Referring to FIG. 3, the ECU 20 confirms whether the inverted edge of the C/F signal falls within the tolerance time of each of t1 and t2 stored in the mapping data when the battery voltage is between 10 V and 14 V.

As a result, if the inverted edge of the C/F signal is out of a normal range of the mapping data by a predetermined number of times, the ECU 20 recognizes the situation as a failure and stores a diagnostic trouble code (DTC) in the memory device.

For example, the failure can be classified into a case where there is no C/F signal, a case where the signal is out of the mapping data, and a case where the signal reaches the first current value but not the second current value. Specifically, if there is no C/F signal, disconnection of the primary coil, burnout of the igniter, unfastening of a connector, disconnection/short circuit of a control wire, failure of the ECU, etc. are expected. If the signal is out of the mapping value, leakage of electricity in the ignition coil, disconnection/short circuit of the primary coil, drop of the battery voltage, partial burnout of the igniter, etc. are expected. If the signal reaches the first current value but not the second current value, bad connection of the connector, disconnection/short circuit in the primary coil, unintentional cold start, multi sparking, etc. are expected.

Next, the self-diagnostic signal generator 11 makes it possible to determine whether sufficient ignition energy is supplied to a spark plug in the course of performing the monitoring operation for the secondary current. This is to determine whether or not the ignition coil 10 misfires wherein occurrence of the misfire may correspond to the case where energy of the secondary current (magnitude and duration of the current) does not exceed the threshold value or the secondary voltage is not generated.

Figure 4:
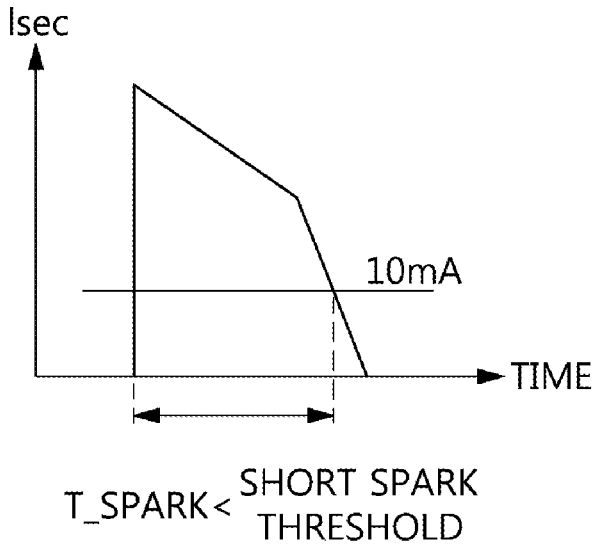
FIG. 4 is a graph showing a criterion for setting a threshold value.

At this time, the self-diagnostic signal generator 11 determines on the basis of the threshold value required for normal spark ignition as shown in FIG. 4 whether or not sufficient ignition energy is supplied to the spark plug with respect to the secondary current shown in the area A in FIG. 2. FIG. 4 is a graph showing a criterion for setting the threshold value. Here, the threshold value is determined based on the current value and the duration of the secondary current, which are important factors in explosion in the actual cylinder.

In this way, when the energy of the secondary current shown in the area A of FIG. 2 does not exceed the threshold value shown in FIG. 3, the self-diagnostic signal generator 11 outputs the F/F signal shortly to the ECU 20 after a time period specified from a starting point of the next D/T lapses. This situation may correspond to disconnection between the primary and secondary coils, leakage of electricity in the primary and secondary coils, failure of the igniter IGT, or the like.

As described above, the F/F signal is a diagnostic signal which is transmitted after the next D/T starting point of the C/F signal when a problem occurs, that is, when the energy of secondary current of the ignition coil 10 does not exceed the threshold value or when the secondary voltage of the ignition coil 10 is not generated.

Further, the self-diagnostic signal generator 11 transmits the F/F signal shortly to the ECU 20 after the next D/T starting point even when the secondary voltage is not generated (i.e., no discharge occurs). This situation may correspond to failure (always turned on or off) of the igniter IGT, disconnection/ground connection of the primary coil, or activation of self-protection function.

As a result, the ECU 20 can distinguish whether upon occurrence of misfire, the misfire is caused by the ignition coil 10, or otherwise by other factors (e.g., external factors of the cylinder). In other words, when the C/F signal is normally transmitted but misfire occurs, if it is determined that sufficient ignition energy is not supplied to the spark plug, the cause of the problem can be limited to the spark plug or the ignition coil, whereas if it is determined that sufficient ignition energy is supplied to the spark plug but misfire occurs, it indicates that the problem is caused by factors other than the spark plug or the ignition coil, that is, compression ratio in the cylinder, oil consumption, backflow of catalyst, etc.

Figure 5:
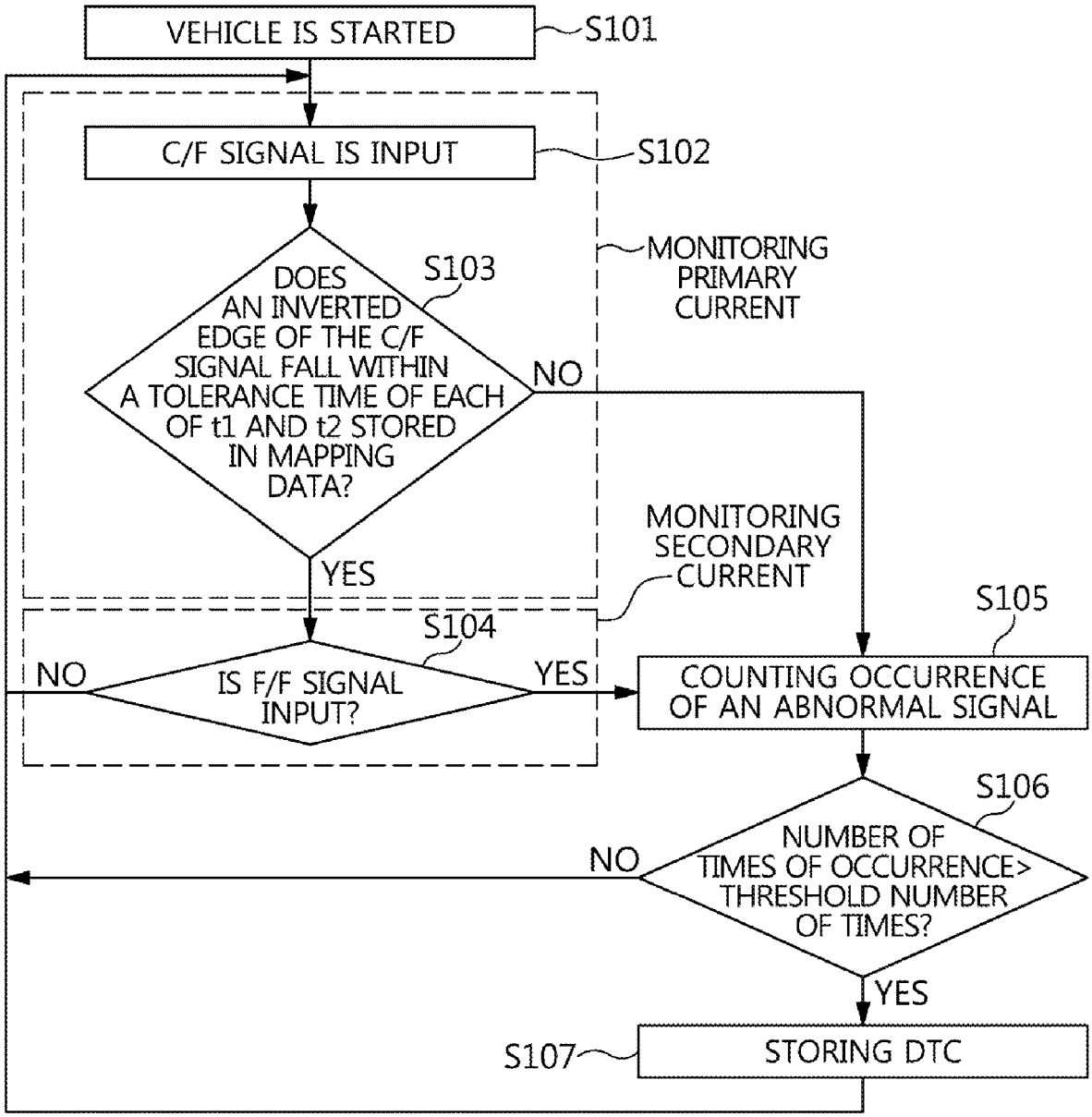
FIG. 5 is a flowchart showing a self-diagnosis method for an ignition coil according to an embodiment of the present disclosure.

FIG. 5 is a flowchart showing a self-diagnosis method for an ignition coil according to an embodiment of the present disclosure.

Referring to FIG. 5, the ECU 20 starts self-diagnosis for the ignition coil 10 when a vehicle is started and continuously repeats the self-diagnosis during a driving cycle in step S101.

First, when receiving the C/F signal transmitted from the self-diagnostic signal generator 11 of the ignition coil 10, the ECU 20 performs monitoring of the primary current. At this time, upon receiving the C/F signal, the ECU 20 confirms whether the inverted edge of the C/F signal falls within the tolerance time of each of t1 and t2 stored in the mapping data in steps S102 and S103.

Thereafter, the ECU 20 performs monitoring of the primary current with respect to the C/F signal in steps S102 and S103 and then proceeds to monitoring of the secondary current and confirms whether the F/F signal is input after the next D/T starting point. Here, the ECU 20 may receive the F/F signal when the energy of secondary current of the ignition coil 10 does not exceed the threshold value or when the secondary voltage of the ignition coil 10 is not generated.

At this time, when no F/F signal is input to the ECU 20 after the next D/T starting point in step S104, the ECU performs monitoring of the primary current again in step S102.

On the contrary, when the F/F signal is input to the ECU 20 after the next D/T starting point in step S104, the ECU determines that an abnormal signal of the ignition coil 10 occurs and in turn counts the number of times of occurrence of the abnormal signal in step S105. In this case, when receiving the F/F signal, the ECU 20 counts occurrence of the abnormal signal and if the number of times of occurrence of the abnormal signal is less than or equal to a threshold number of times, then the ECU resumes monitoring of the primary current in the next cycle in step S106.

Referring again to step S103, if it is determined through monitoring of the primary current with respect to the C/F signal that the inverted edge of the C/F signal does not fall within the tolerance time of each of t1 and t2 stored in the mapping data in step S103, the ECU 20 counts the number of times of occurrence of the abnormal signal in step S105.

In this way, the ECU 20 determines occurrence of the abnormal signal of the ignition coil 10 based on the result of confirming the C/F signal and the F/F signal respectively and counts the number of times of occurrence of the abnormal signal in step S105.

At this time, the ECU 20 stores the diagnostic trouble code (DTC) in the memory device when the number of times of occurrence of the abnormal signal exceeds a preset threshold number of times (for example, 30 times) in steps S106 and S107.

In some embodiments, the method may be implemented in the form of a programmed command that can be executed through various computer commands and/or algorithms, which may be recorded on a computer readable medium. The computer readable medium may contain programmed commands, data files, data architectures and the like alone, or in combination with each other. The programmed commands recorded on the medium may be those designed and configured specially for embodiments of the present disclosure or may be available to those skilled in the art of computer software. Examples of the computer readable medium include magnetic media such as hard disks, floppy disks and magnetic tape; optical media such as CD-ROMs and DVDs; magneto-optical media such as floppy disks; and hardware devices configured specially to store and execute programmed commands such as ROM, RAM and flash memory. Examples of programmed commands include machine language codes such as those produced by a compiler as well as high-level language codes that can be executed by a computer using an interpreter or the like.

Although the foregoing description has been described with a focus on novel features of the present disclosure that can be applied to various embodiments, those skilled in the art will appreciate that various deletions, substitutions and alterations can be made to the forms and details of the devices and methods described above without departing from the scope of the disclosure. Therefore, the scope of the present disclosure is defined by the appended claims rather than the foregoing description. All variations within the scope of the appended claims are embraced within the scope of the present disclosure.

What is claimed is:

1. An electronic control unit (ECU), comprising at least one processor; and a memory device for storing computer readable commands, wherein the commands, when executed by the at least one processor, cause the electronic control unit to receive and confirm a current flag (C/F) signal through monitoring of primary current of an ignition coil; to monitor secondary current of the ignition coil upon receiving the C/F signal and confirm whether a fault flag (F/F) signal for determining whether misfire of the ignition coil occurs is input; and to determine whether an abnormal signal of the ignition coil is generated based on the result of confirming the C/F signal and the F/F signal respectively.

2. The electronic control unit according to claim 1, wherein the C/F signal is a square wave shaped self-diagnostic signal obtained by inverting voltage of a diagnostic line when the primary current passes along two preset specific current value points.

3. The electronic control unit according to claim 2, wherein the F/F signal is a self-diagnostic signal to be transmitted when energy of the secondary current of the ignition coil does not exceed a threshold value or when secondary voltage of the ignition coil is not generated.

4. The electronic control unit according to claim 3, wherein the energy of the secondary current is determined based on magnitude and duration of the current of the ignition coil.

5. The electronic control unit according to claim 2, wherein the commands, when executed by the at least one processor, cause the electronic control unit to confirm, at the time of receiving and confirming the current flag (C/F) signal, whether an inverted edge of the C/F signal falls within a tolerance time of each of the two specific current value points set in mapping data.

6. The electronic control unit according to claim 5, wherein the mapping data is established by measuring time of each of the two specific current value points when the primary current rises depending on conditions of battery voltage, temperature and revolution per minute (RPM) in a single product of the actual ignition coil.

7. The electronic control unit according to claim 6, wherein the time of each of the two specific current value points set in the mapping data has a range between a high value and a low value depending on the battery voltage.

8. The electronic control unit according to claim 7, wherein the time of each of the two specific current value points set in the mapping data is set after confirming an overlap section.

9. A self-diagnostic signal generator, comprising at least one processor; and a memory device for storing computer readable commands, wherein the commands, when executed by the at least one processor, cause the self-diagnostic signal generator to be connected to a ground (GND) of a primary side of an ignition coil and monitor primary current; to be connected to a power source of a secondary side of the ignition coil and monitor secondary current; and to transmit a current flag (C/F) signal to an electronic control unit based on the result of monitoring the primary current of the ignition coil and transmit a fault flag (F/F) signal to the electronic control unit based on the result of monitoring the secondary current of the ignition coil.

10. The self-diagnostic signal generator according to claim 9, wherein the C/F signal is a square wave shaped self-diagnostic signal obtained by inverting voltage of a diagnostic line when the primary current passes along two preset specific current value points.

11. The self-diagnostic signal generator according to claim 9, wherein the F/F signal is a self-diagnostic signal to be transmitted when energy of the secondary current of the ignition coil does not exceed a threshold value or when secondary voltage of the ignition coil is not generated.

12. A self-diagnosis method for an ignition coil, comprising:

receiving and confirming a current flag (C/F) signal through monitoring of primary current of an ignition coil by an electronic control unit (ECU);

monitoring, by the ECU, secondary current of the ignition coil upon receiving the C/F signal and confirming whether a fault flag (F/F) signal for determining whether misfire of the ignition coil occurs is input; and determining, by the ECU, whether an abnormal signal of the ignition coil is generated based on the result of confirming the C/F signal and the F/F signal respectively.

13. The self-diagnosis method according to claim 12, wherein the C/F signal is a square wave shaped self-diagnostic signal obtained by inverting voltage of a diagnostic line when the primary current passes along two preset specific current value points.

14. The self-diagnosis method according to claim 13, wherein the F/F signal is a self-diagnostic signal to be transmitted when energy of the secondary current of the ignition coil does not exceed a threshold value or when secondary voltage of the ignition coil is not generated.

15. The self-diagnosis method according to claim 14, wherein the energy of the secondary current is determined based on magnitude and duration of the current of the ignition coil.

16. The self-diagnosis method according to claim 13, wherein receiving and confirming the C/F signal comprises confirming whether an inverted edge of the C/F signal falls within a tolerance time of each of the two specific current value points set in mapping data.

17. The self-diagnosis method according to claim 16, wherein the mapping data is established by measuring time of each of the two specific current value points when the primary current rises depending on conditions of battery voltage, temperature and revolution per minute (RPM) in a single product of the actual ignition coil.

18. The self-diagnosis method according to claim 17, wherein the time of each of the two specific current value points set in the mapping data has a range between a high value and a low value depending on the battery voltage.

19. The self-diagnosis method according to claim 18, wherein the time of each of the two specific current value points set in the mapping data is set after confirming an overlap section.

20. The self-diagnosis method according to claim 12, wherein determining whether the abnormal signal of the ignition coil is generated comprises storing a diagnostic trouble code (DTC) in a memory device when a number of times of generating an abnormal signal exceeds a preset threshold value.

* * * * *